US010830558B2

(12) United States Patent
Underwood et al.

(10) Patent No.: US 10,830,558 B2
(45) Date of Patent: Nov. 10, 2020

(54) BUTTSTOCK LOCK RELEASE LEVER PIN ASSEMBLY

(71) Applicants: James Matthew Underwood, Kennesaw, GA (US); Larry Cullen Underwood, Canton, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 0 days.

(21) Appl. No.: 16/565,311

(22) Filed: Sep. 9, 2019

(65) Prior Publication Data

US 2020/0141689 A1 May 7, 2020

Related U.S. Application Data

(60) Provisional application No. 62/729,315, filed on Sep. 10, 2018.

(51) Int. Cl.
*F41C 23/14* (2006.01)
*F41C 23/04* (2006.01)

(52) U.S. Cl.
CPC ..... *F41C 23/14* (2013.01); *F41C 23/04* (2013.01)

(58) Field of Classification Search
CPC ..... F41C 23/14; F41C 23/04; F16B 39/00; F16B 39/28
USPC ..... 42/73; 411/141
See application file for complete search history.

(56) References Cited

U.S. PATENT DOCUMENTS 2,571,641 A * 10/1951 Wing ..... F16B 5/10 411/141
2,577,335 A * 12/1951 Lambert ..... F41A 19/54 42/12
2,645,873 A * 7/1953 Crittendon ..... F41A 3/40 42/21
2,719,375 A * 10/1955 Crittendon ..... F41C 7/02 42/17
3,348,328 A * 10/1967 Roy ..... F41C 23/04 42/73
5,352,398 A * 10/1994 Crowe ..... B29C 33/02 249/66.1
6,955,515 B2 * 10/2005 Barina ..... F16B 21/02 411/508
7,849,626 B2 * 12/2010 Fluhr ..... F41C 23/04 42/73
8,341,868 B2 * 1/2013 Zusman ..... F41C 23/22 42/73
8,387,298 B2 * 3/2013 Kincel ..... F41C 23/04 42/71.01
8,978,285 B1 * 3/2015 Burke ..... F41C 23/14 42/73
9,500,214 B2 * 11/2016 Kleppen ..... F16B 19/10
10,234,226 B1 * 3/2019 Copeland ..... F41A 17/38
2007/0261284 A1 * 11/2007 Keng ..... F41C 23/22 42/73
2010/0242333 A1 * 9/2010 Kincel ..... F41C 23/14 42/73

(Continued)

*Primary Examiner* — Joshua E Freeman

(57) ABSTRACT

A lock release lever pin assembly for an adjustable buttstock assembly of a firearm, wherein the lock release lever pin assembly includes a lock release lever pin including a first end and a second end and a lock pin nut that engages the first end of the lock release lever pin. The first end of the lock release lever pin includes at least one insertion portion and at least one retaining portion.

28 Claims, 5 Drawing Sheets

(56) References Cited

U.S. PATENT DOCUMENTS

| | | | | |
|---|---|---|---|---|
| 2010/0313742 | A1* | 12/2010 | Silva | F41A 1/04 89/7 |
| 2011/0173863 | A1* | 7/2011 | Ingram | F41C 23/14 42/73 |
| 2012/0137562 | A1* | 6/2012 | Langevin | F41C 23/14 42/75.03 |
| 2013/0097911 | A1* | 4/2013 | Larue | F41C 23/04 42/73 |
| 2016/0116250 | A1* | 4/2016 | Mather | F41C 23/04 42/73 |
| 2016/0202016 | A1* | 7/2016 | Mather | F41C 23/14 42/73 |
| 2018/0250981 | A1* | 9/2018 | Phillips | B25B 23/0035 |
| 2019/0049213 | A1* | 2/2019 | Yang | F41C 23/14 |
| 2019/0234449 | A1* | 8/2019 | Carranco | B60B 3/165 |
| 2020/0141689 | A1* | 5/2020 | Underwood | F41C 23/14 |
| 2020/0149580 | A1* | 5/2020 | Abou Halima | F16B 37/14 |

* cited by examiner

BUTTSTOCK LOCK RELEASE LEVER PIN ASSEMBLY

CROSS REFERENCE TO RELATED APPLICATION

This application is related to and claims priority benefit from U.S. Provisional Application No. 62/729,315 ("the '315 application"), filed on Sep. 10, 2018 and entitled "BUTTSTOCK LOCK RELEASE LEVER PIN ASSEMBLY." The '315 application is hereby incorporated in its entirety by this reference.

FIELD OF THE INVENTION

The field of the invention relates to firearms, particularly methods and devices for adjustable buttstocks of a firearm.

BACKGROUND

Numerous firearms include or may be modified to include an adjustable buttstock. Adjustable and/or collapsible buttstocks allow a user to change a length of pull and overall firearm length to suit a specific user and/or a specific situation (e.g., to compensate for a user with longer or shorter arms or a user wearing thicker clothes, including body armor). For purposes of this application, collapsible buttstocks are one type of adjustable buttstock. Many modern firearms (including handguns, rifles, carbines, shotguns, etc.) may include an adjustable buttstock. Most adjustable buttstocks include a mechanism for allowing the stock to move between a plurality of positions. For many adjustable buttstocks, the mechanism includes a release lever that is attached to a sliding buttstock using a lock release lever pin 51 (with a threaded shaft), a lock release lever pin spring, a lock pin nut 53 (with corresponding internal threads to engage the threaded shaft of the lock release lever pin 51), and a lock nut roll pin 55 where the lock nut roll pin 55 is inserted through (i) a hole 54 in the lock pin nut 53 and (ii) a hole 52 in the shaft of the lock release lever pin 51 to secure the lock pin nut 53 relative to the lock release lever pin 51 (see FIG. 5).

In some cases, the lock nut roll pin 55 is difficult to install and/or remove and, in some cases, the installation/removal may cause damage to one or more components of the firearm. Accordingly, it may be desirable to design an assembly for attaching an adjustable buttstock release lever to an adjustable buttstock without a roll pin.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a lock release lever pin assembly for an adjustable buttstock assembly of a firearm comprises: a lock release lever pin comprising a first end and a second end; and a lock pin nut that engages a first end of the lock release lever pin, wherein the first end of the lock release lever pin comprises at least one insertion flat portion and at least one retaining flat portion.

According to certain embodiments of the present invention, an adjustable buttstock assembly of a firearm comprises: an adjustable buttstock defining a receiver extension hole; a release lever positionable on a lower end of the adjustable buttstock and comprising a lower surface; a lock release lever pin comprising a first end and a second end, the lock release lever pin extending through the release lever and the adjustable buttstock and at least partially into the receiver extension hole; and a lock pin nut that engages the first end of the lock release lever pin and is positionable to contact the lower surface of the release lever, wherein the first end of the lock release lever pin comprises an insertion flat portion and a retaining flat portion.

According to certain embodiments of the present invention, a method of installing a lock release lever pin assembly comprises: inserting a first end of a lock release lever pin into a vertical hole of an adjustable buttstock; aligning at least one internal protrusion of a lock pin nut with at least one insertion flat portion of the lock release lever pin; inserting the first end of the lock release lever pin into a through-hole of the lock pin nut; and rotating the lock pin nut relative to the lock release lever pin such that the at least one internal protrusion is aligned with at least one retaining flat portion of the lock release lever pin.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments shown in FIGS. 1A-4B focus on assemblies for adjustable buttstocks for semi-automatic rifles/carbines, the features, concepts, and functions described herein may also be applicable (with potential necessary alterations for particular applications) to other firearms including handguns, shotguns, or any other type of firearm. The lock release lever pin assembly 100 described herein may be retrofitted into a conventional adjustable buttstock or may be a component of a retail product. The lock release lever pin assembly 100 may function to make an adjustable buttstock easier to assemble/disassemble.

Figure 1A:
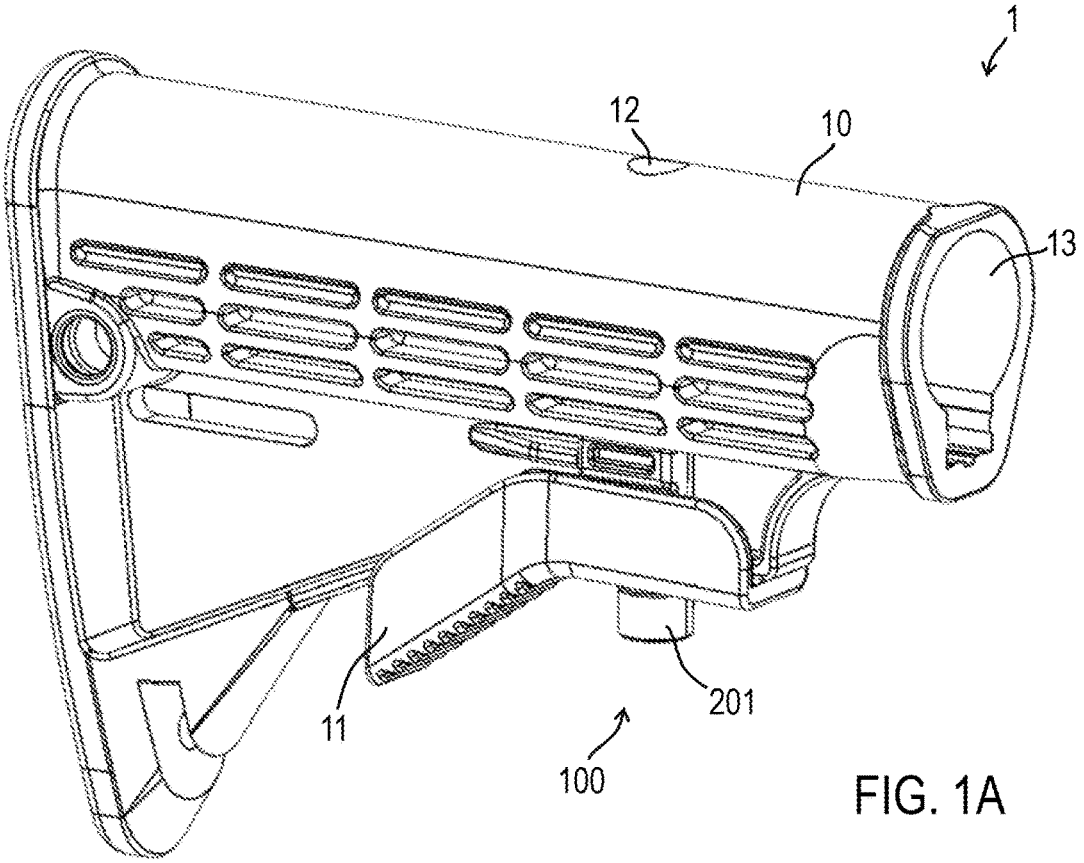
FIG. 1A is a front perspective view of an adjustable buttstock assembly, according to certain embodiments of the present invention.
Figure 1B:
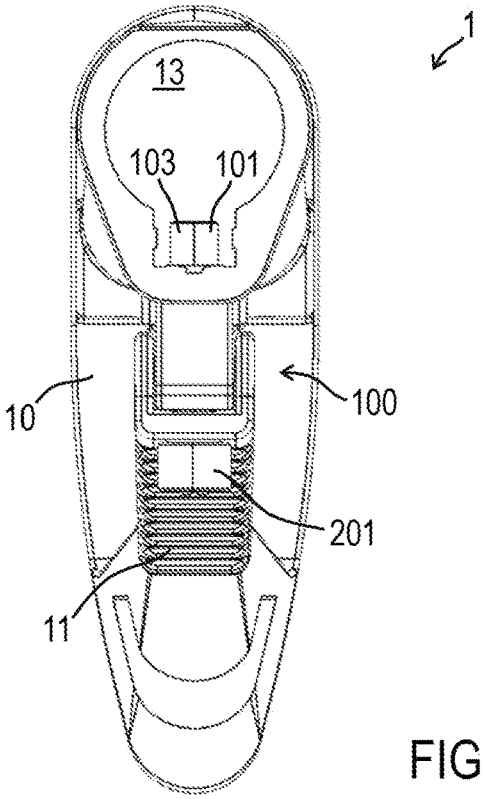
FIG. 1B is a front view of the adjustable buttstock assembly of FIG. 1A.
Figure 2:
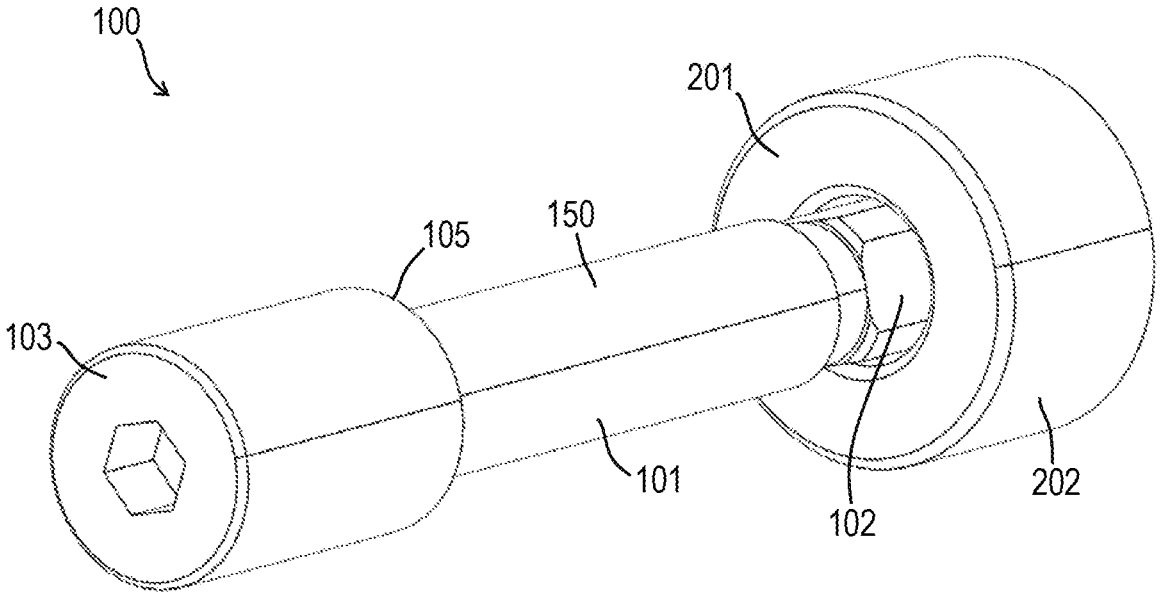
FIG. 2 is a perspective view of a lock release lever pin assembly of FIG. 1A.

According to certain embodiments of the present invention, as shown in FIGS. 1A-2, a lock release lever pin assembly 100 may interface with an adjustable buttstock assembly 1 of a firearm. The adjustable buttstock assembly 1 may include an adjustable buttstock 10 and a release lever 11. The lock release lever pin assembly 100 may be capable of being assembled and disassembled from a firearm or may be permanently attached. The lock release lever pin assembly 100 facilitates the attachment of the release lever 11 to the adjustable buttstock 10.

In some embodiments of the present invention, as shown in FIGS. 1A-2, the lock release lever pin assembly 100 includes a lock release lever pin 101 and a lock pin nut 201. The lock release lever pin assembly 100 includes a spring surrounding a center shaft 150 of the lock release lever pin 101. However, this spring is not shown to better illustrate the features of the lock release lever pin assembly 100.

The lock release lever pin assembly 100 may be inserted into vertical hole 12 of the adjustable buttstock 10 such that the lock pin nut 201 is disposed below the release lever 11 and a second end 103 of the lock release lever pin 101 is disposed inside a receiver extension hole 13 of the adjustable buttstock 10 (i.e., a step 105 of the lock release lever pin 101 bears against a surface of a counter-bored hole within the receiver extension hole 13). In operation, the spring (not shown) surrounding the center shaft 150 pushes the lock release lever pin assembly 100 such that the second end 103 extends into the receiver extension hole 13 (as shown in FIG. 1B) such that the second end 103 would interface with one of a plurality holes in a receiver extension tube (not shown) to locate the adjustable buttstock 10. To adjust the location of the adjustable buttstock 10 (relative to the receiver extension tube), a user pivots the release lever 11, which pulls the lock pin nut 201 downward against the resistance provided by the spring such that the second end 103 moves out of the receiver extension hole 13 (into the counter-bored hole in the adjustable buttstock 10). The movement of the second end 103 out of the receiver extension hole 13 (and out of one of the holes in the receiver extension tube) allows the adjustable buttstock 10 to move relative to the receiver extension tube.

Figure 3A:
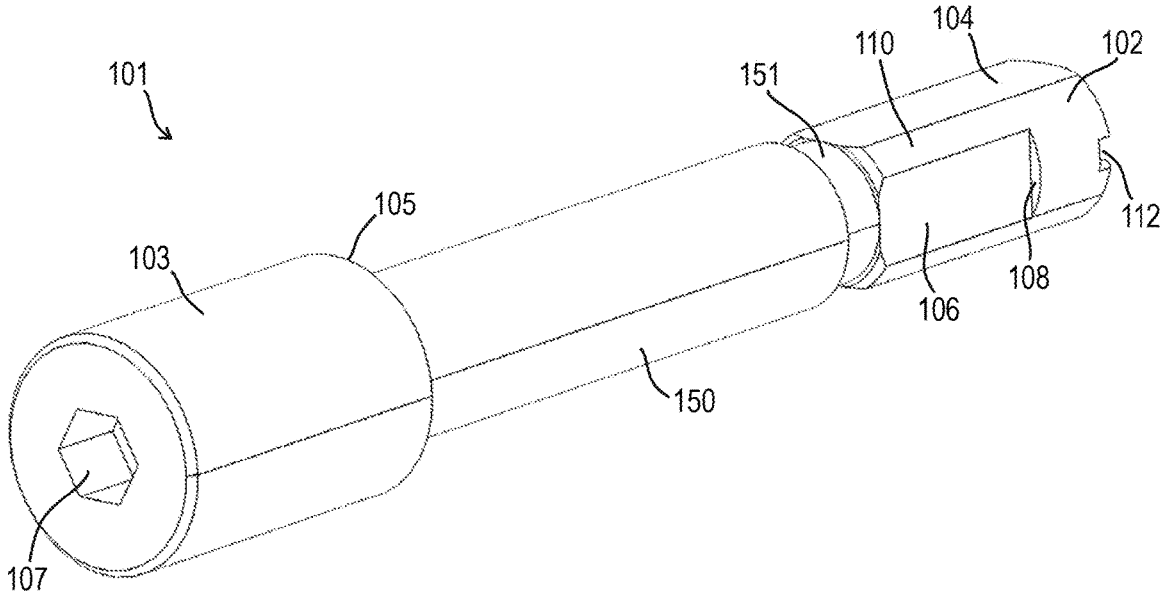
FIGS. 3A and 3B are perspective views of a lock release lever pin of FIG. 1A.
Figure 3B:
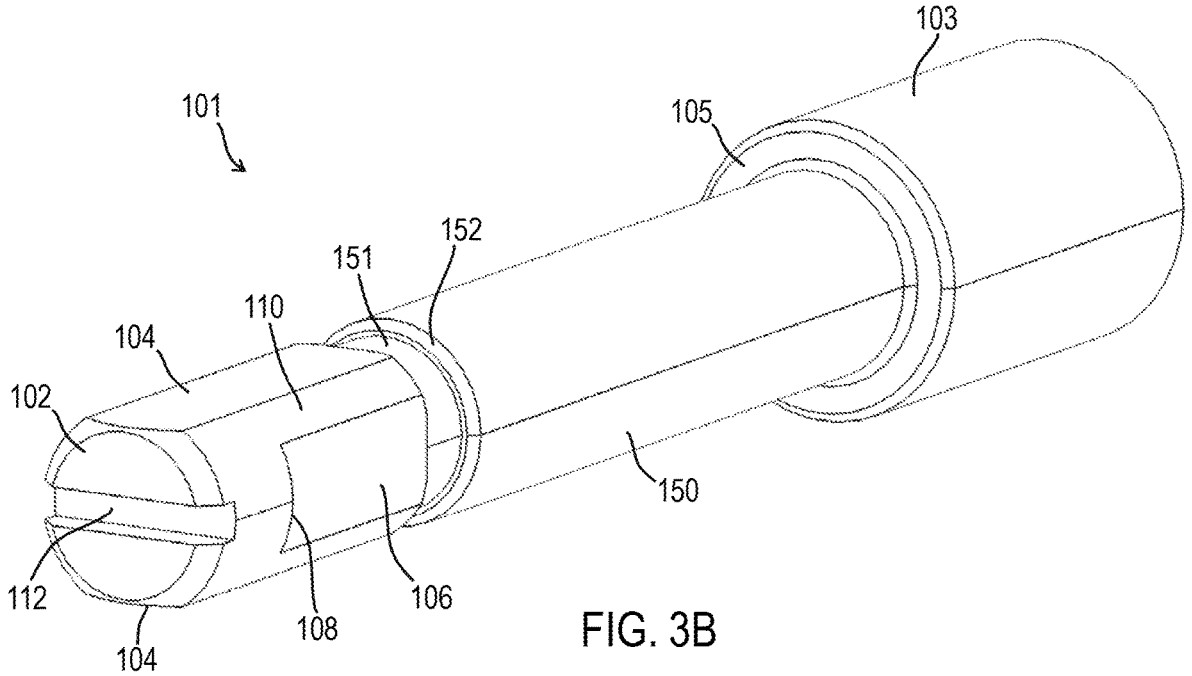

As shown in FIGS. 2-3B, the lock release lever pin 101 includes a first end 102 and a second end 103 at opposite ends of the center shaft 150 such that the first end 102 interfaces with the lock pin nut 201 when the components are assembled. The second end 103 includes a fastener head defined by the step 105 between the diameter of the head and the diameter of the center shaft 150. The fastener head at the second end 103 may include a tool interface 107. Although the tool interface 107 is illustrated as a hexagonal recess, the tool interface 107 is not limited to recessed features and may be configured to engage numerous types of fasteners including, for example, flat head, Phillips, hexagonal, Torx, or any other appropriate fastener type. In some embodiments, the lock release lever pin 101 includes a circumferential channel 151 adjacent to the first end 102.

Figure 4A:
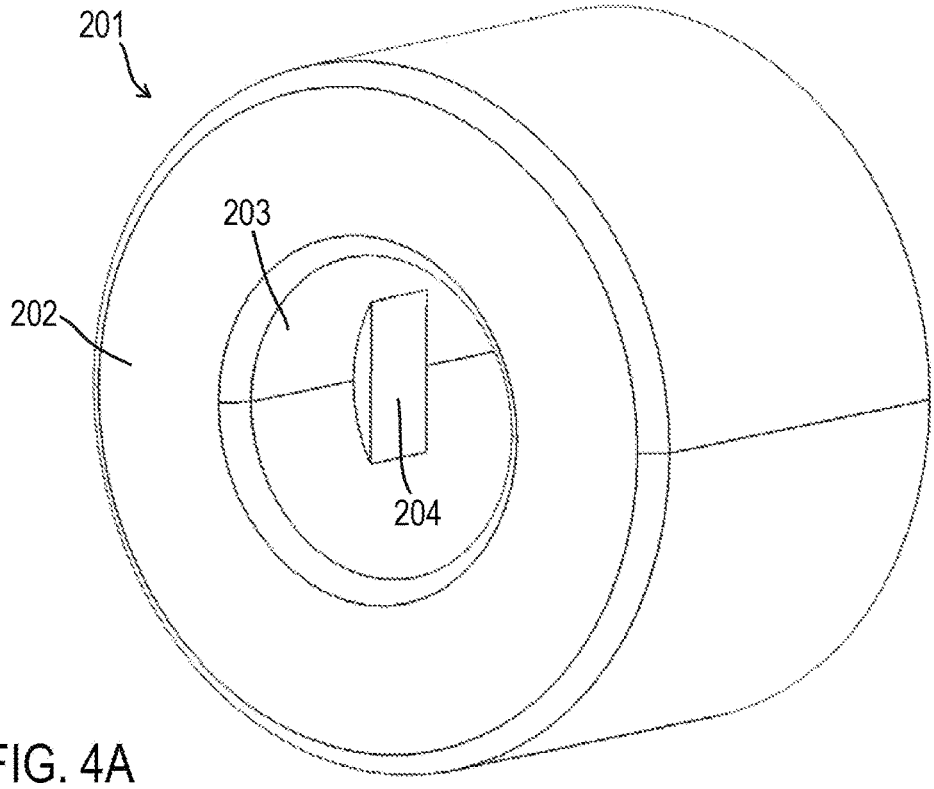
FIG. 4A is a perspective view of a lock pin nut of FIG. 1A.
Figure 4B:
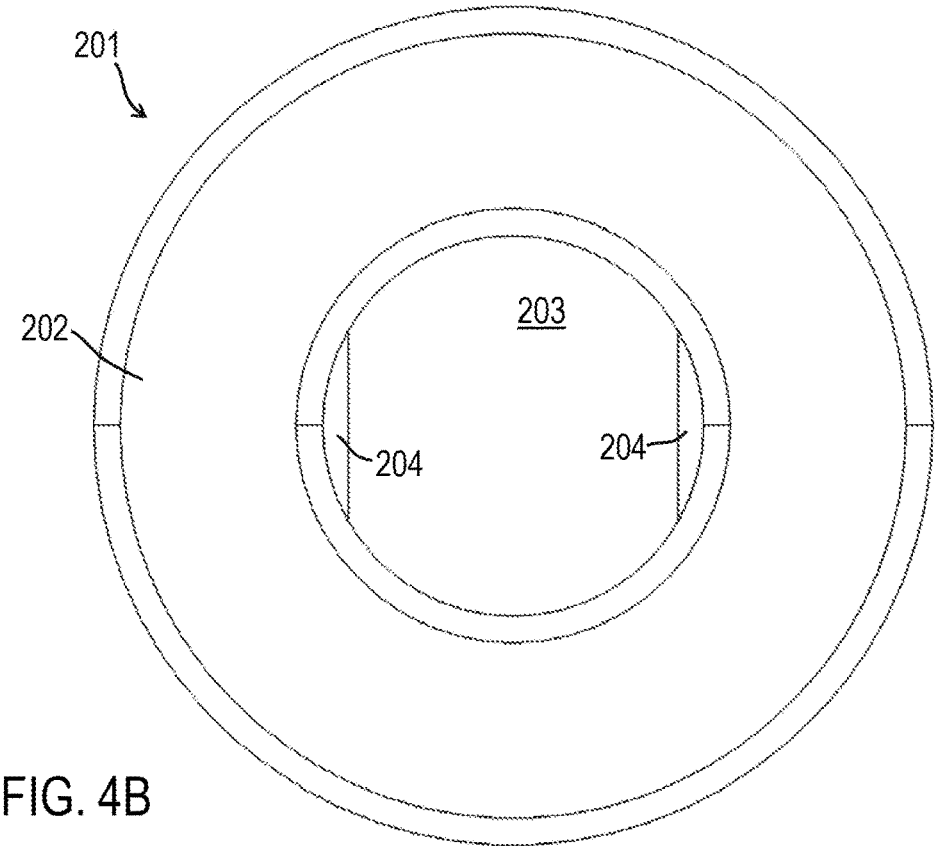
FIG. 4B is a front view of the lock pin nut of FIG. 1A.
Figure 5:
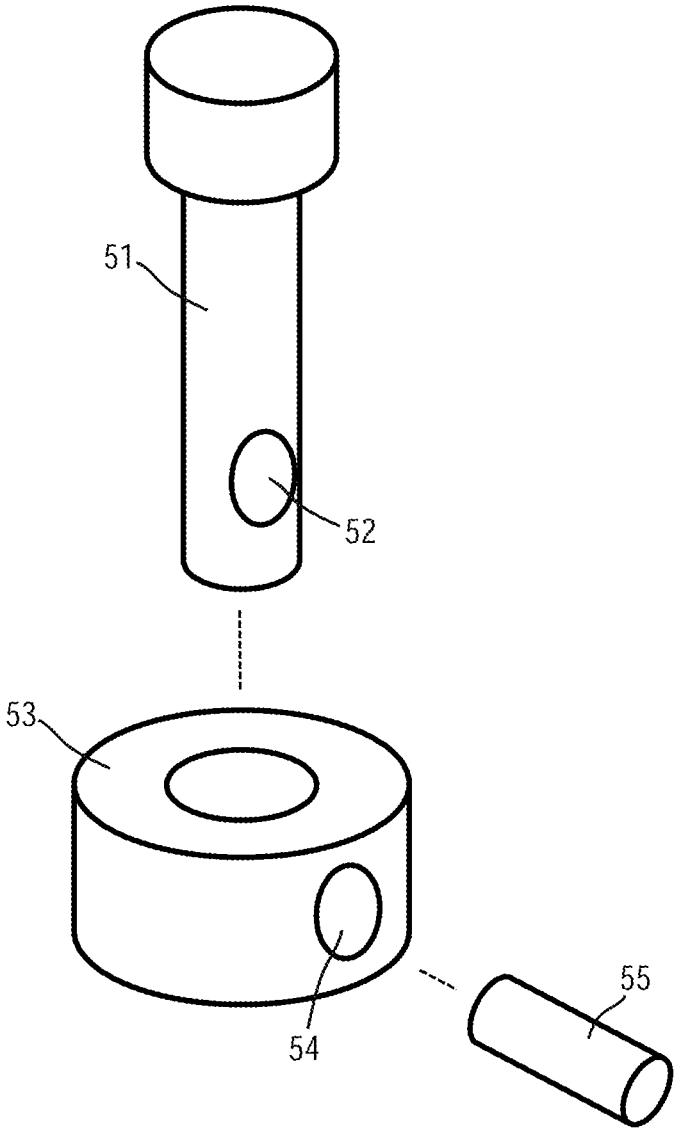
FIG. 5 Prior Art
FIG. 5 is a schematic exploded perspective view of a conventional lock release lever pin assembly.

As shown in FIGS. 3A and 3B, the lock release lever pin 101 includes at least one insertion portion 104, which extends a full length from the first end 102 to the circumferential channel 151. The at least one insertion portion 104 may include a flat or planar surface while in other cases, the insertion portion 104 may include a surface that includes some curvature but is more flat than other portions of the first end 102. The lock release lever pin 101 also includes at least one retaining portion 106, which extends between a step 108 and the circumferential channel 151. In other words, the at least one retaining portion 106 extends a partial length between the circumferential channel 151 and the first end 102. The at least one retaining portion 106 may include a flat or planar surface while in other cases, the retaining portion 106 may include a surface that includes some curvature but is more flat than other portions of the first end 102. In between the at least one insertion portion 104 and the at least one retaining portion 106, there is a full diameter portion 110, which has approximately the same diameter as the center shaft 150. The first end 102 may also include a tool interface 112. Although the tool interface 112 is illustrated as a recessed linear slot, the tool interface 112 is not limited to recessed features and may be configured to engage numerous types of fasteners including, for example, flat head, Phillips, hexagonal, Torx, or any other appropriate fastener type. As shown in FIGS. 4A and 4B, the lock pin nut 201 includes an annular body 202, a through-hole 203, and at least one internal protrusion 204.

In some embodiments, to install the lock release lever pin assembly 100, the first end 102 of the lock release lever pin 101 is inserted through the vertical hole 12 on the upper side of the adjustable buttstock 10. The first end 102 of the lock release lever pin 101 is then inserted through the adjustable buttstock 10 and the release lever 11 such that the lock pin nut 201 can engage the first end 102 of the lock release lever pin 101. The lock pin nut 201 and the lock release lever pin 101 are arranged such that at least one internal protrusion 204 of the lock pin nut 201 is aligned with the at least one insertion portion 104 of the lock release lever pin 101. If the at least one internal protrusion 204 and the at least one insertion portion 104 are not aligned, the first end 102 of the lock release lever pin 101 can only be inserted as far as the at least one internal protrusion 204 (within the through-hole 203). When the at least one internal protrusion 204 and the at least one insertion portion 104 are aligned, the lock pin nut 201 can move in an axial direction relative to the lock release lever pin 101. However, the lock pin nut 201 cannot move in a rotational direction relative to the lock release lever pin 101 because the full diameter portion 110 interferes with a potential rotational movement of the at least one internal protrusion 204 of the lock pin nut 201.

To engage the lock release lever pin assembly 100, the lock pin nut 201 is pressed toward the second end 103 of the lock release lever pin 101 to a maximum depth position. The maximum depth position occurs when the at least one internal protrusion 204 contacts a step 152 adjacent to the circumferential channel 151 (requires compressing the spring located at the center shaft 150). The lock pin nut 201 can then be rotated relative to the lock release lever pin 101 (i.e., the at least one internal protrusion 204 moves through the circumferential channel 151). In some embodiments, turning the lock pin nut 201 approximately 90° (i.e., a quarter turn) aligns the at least one internal protrusion 204 (of the lock pin nut 201) with the at least one retaining portion 106 (of the lock release lever pin 101). After aligning the at least one internal protrusion 204 with the at least one retaining portion 106 and releasing the pressure compressing the spring located at the center shaft 150, the at least one internal protrusion 204 is pressed against the step 108 adjacent to the at least one retaining portion 106.

The components of the lock release lever pin assembly 100 described herein may be formed of materials including, but not limited to, carbon composite, plastic, thermoplastic, nylon, steel, aluminum, stainless steel, high strength aluminum alloy, other plastic or polymer materials, other metallic materials, other composite materials, or other similar materials. Moreover, the components of the firearms may be attached to one another via suitable fasteners, which include, but are not limited to, screws, bolts, rivets, welds, co-molding, injection molding, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A buttstock assembly for a firearm, the buttstock assembly comprising:

a lock release lever pin assembly comprising:

a lock release lever pin comprising a first end and a second end; and a lock pin nut that engages the first end of the lock release lever pin, wherein the first end of the lock release lever pin comprises at least one insertion portion comprising a planar surface and at least one retaining portion comprising a planar surface.

2. The buttstock assembly of claim 1, wherein the lock pin nut comprises:

a first end;

a second end;

a through-hole extending between the first end and the second end; and at least one internal protrusion positioned within the through-hole.

3. The buttstock assembly of claim 2, wherein the at least one internal protrusion is offset from both the first end and the second end.

4. The buttstock assembly of claim 1, wherein:

the lock release lever pin comprises a circumferential channel;

the at least one insertion portion extends a full length between the circumferential channel and the first end; and the at least one retaining portion extends a partial length between the circumferential channel and the first end.

5. The buttstock assembly of claim 4, wherein the at least one retaining portion extends a partial length from the circumferential channel to a step located toward the first end, the step comprising a larger outermost dimension than an outermost dimension of the at least one retaining portion.

6. The buttstock assembly of claim 4, wherein the lock pin nut comprises a through-hole and at least one internal protrusion positioned within the through-hole.

7. The buttstock assembly of claim 6, wherein:

the at least one internal protrusion is aligned with at least one selected from the group of (i) the at least one insertion portion and (ii) the at least one retaining portion; and the lock pin nut is moveable in an axial direction relative to the lock release lever pin such that the at least one internal protrusion of the lock pin nut slides adjacent to at least one selected from the group of (i) the at least one insertion portion and (ii) the at least one retaining portion.

8. The buttstock assembly of claim 6, wherein when the at least one internal protrusion is aligned with the circumferential channel of the lock release lever pin, the lock pin nut is rotatable with respect to the lock release lever pin.

9. The buttstock assembly of claim 4, wherein the circumferential channel is recessed relative to (i) an entirety of the at least one insertion portion and (ii) an entirety of the at least one retaining portion.

10. The buttstock assembly of claim 1, wherein the first end comprises a first tool interface and the second end comprises a second tool interface.

11. The buttstock assembly of claim 1, wherein the first end of the lock release lever pin comprises a full diameter portion that extends between the at least one insertion portion and the at least one retaining portion.

12. An adjustable buttstock assembly for a firearm comprising:

an adjustable buttstock defining a receiver extension hole;

a release lever positionable on a lower side of the adjustable buttstock and comprising a lower surface;

a lock release lever pin comprising a first end and a second end, the lock release lever pin extending through the release lever and the adjustable buttstock and at least partially into the receiver extension hole; and a lock pin nut that engages the first end of the lock release lever pin, wherein the lock pin nut is positionable to contact the lower surface of the release lever, the lock pin nut comprising a first end, a second end, a through-hole extending between the first end and the second end, and at least one internal protrusion positioned within the through-hole, wherein:

the at least one internal protrusion is offset from both the first end and the second end; and the first end of the lock release lever pin comprises at least one insertion portion and at least one retaining portion.

13. The adjustable buttstock assembly of claim 12, wherein the lock release lever pin comprises a step defining a fastener head proximate the second end that engages with an inner surface of the adjustable buttstock.

14. The adjustable buttstock assembly of claim 12, wherein the release lever is pivotable to cause the lock release lever pin to move relative to the receiver extension hole.

15. The adjustable buttstock assembly of claim 12, wherein:

the lock release lever pin comprises a circumferential channel;

the at least one insertion portion extends a full length between the circumferential channel and the first end; and the at least one retaining portion extends a partial length between the circumferential channel and the first end.

16. The adjustable buttstock assembly of claim 15, wherein the circumferential channel is recessed relative to (i) an entirety of the at least one insertion portion and (ii) an entirety of the at least one retaining portion.

17. The adjustable buttstock assembly of claim 12, wherein the at least one internal protrusion comprises a planar surface facing a central axis of the lock pin nut.

18. The adjustable buttstock assembly of claim 12, wherein:

the at least one internal protrusion is aligned with at least one selected from the group of (i) the at least one insertion portion and (ii) the at least one retaining portion; and when the lock release lever pin is inserted into the through-hole and the lock pin nut is moveable in an axial direction relative to the lock release lever pin, the at least one internal protrusion of the lock pin nut slides adjacent to at least one selected from the group of (i) the at least one insertion portion and (ii) the at least one retaining portion.

19. The adjustable buttstock assembly of claim 12, wherein when the at least one internal protrusion is aligned with a circumferential channel of the lock release lever pin, the lock pin nut is rotatable with respect to the lock release lever pin.

20. The adjustable buttstock assembly of claim 12, wherein the at least one insertion portion comprises a planar surface and the at least one retaining portion comprises a planar surface.

21. The adjustable buttstock assembly of claim 12, wherein the first end comprises a first tool interface and the second end comprises a second tool interface.

22. The adjustable buttstock assembly of claim 12, wherein the first end of the lock release lever pin comprises a full diameter portion that extends between the at least one insertion portion and the at least one retaining portion.

23. A method of installing a lock release lever pin assembly, the method comprising:

inserting a first end of a lock release lever pin into a vertical hole of an adjustable buttstock;

aligning at least one internal protrusion of a lock pin nut with at least one insertion portion of the lock release lever pin;

inserting the first end of the lock release lever pin into a through-hole of the lock pin nut; and rotating the lock pin nut relative to the lock release lever pin such that the at least one internal protrusion is aligned with at least one retaining portion of the lock release lever pin, wherein the at least one insertion portion comprises a planar surface and the at least one retaining portion comprises a planar surface.

24. The method of claim 23, wherein the lock pin nut rotates approximately 90° relative to the lock release lever pin to align the at least one internal protrusion with the at least one retaining portion of the lock release lever pin.

25. The method of claim 23, wherein inserting the first end of the lock release lever pin into the vertical hole of the adjustable buttstock comprises positioning the first end below a lower surface of the adjustable buttstock and positioning a second end of the lock release lever pin inside a receiver extension hole.

26. The method of claim 25, wherein the lock release lever pin comprises a step located between the first end and the second end of the lock release lever pin, the step defining a maximum depth position.

27. The method of claim 25, wherein the lock release lever pin comprises a circumferential channel having a smaller outermost dimension than an outermost dimension of a center shaft portion of the lock release lever pin and an outermost dimension of a full diameter portion of the lock release lever pin at the first end.

28. The method of claim 27, further comprising aligning the at least one internal protrusion with the circumferential channel, wherein rotating the lock pin nut comprises rotating the lock pin nut while the at least one internal protrusion is aligned with the circumferential channel.

* * * * *